United States Patent [19]

Molenaar

[11] 4,269,625

[45] May 26, 1981

[54] BATH FOR ELECTROLESS DEPOSITING TIN ON SUBSTRATES

[75] Inventor: Arian Molenaar, Eindhoven, Netherlands

[73] Assignee: U.S. Philips Corporation, New York, N.Y.

[21] Appl. No.: 93,484

[22] Filed: Nov. 13, 1979

[30] Foreign Application Priority Data

Dec. 4, 1978 [NL] Netherlands ..... 7811816

[51] Int. Cl.[3] ..... C23C 3/02

[52] U.S. Cl. ..... 106/1.22; 106/1.25; 427/437; 427/443.1

[58] Field of Search ..... 106/1.22, 1.25; 204/54 L; 427/437, 443.1

[56] References Cited

U.S. PATENT DOCUMENTS

| | | | |
|---|---|---|---|
| 921,943 | 5/1909 | Beneker | 204/54 L |
| 3,072,498 | 1/1963 | Knowles et al. | 427/437 |
| 3,403,035 | 9/1968 | Schneble et al. | 106/1.25 |
| 3,616,291 | 10/1971 | Wilson | 106/1.25 |
| 3,637,386 | 1/1972 | De Ruig et al. | 96/60 |
| 3,870,526 | 3/1975 | Pearlstein et al. | 106/1.22 |

*Primary Examiner*—Lorenzo B. Hayes

*Attorney, Agent, or Firm*—Norman N. Spain

[57] ABSTRACT

Method of currentless deposition of tin on a catalytic surface by means of a highly alkaline solution which contains stannous ions in a quantity of at least 0.20 mole/l and is used at temperatures of 60° to 90° C. The solution operates on the basis of the mechanism of disproportioning of stannous ions. The tin deposition is, however, accelerated by means of a strong reducing agent such as a hypophosphite.

6 Claims, No Drawings

BATH FOR ELECTROLESS DEPOSITING TIN ON SUBSTRATES

BACKGROUND OF THE INVENTION

The invention relates to a bath for electroless depositing tin on metallic and non-metallic substrates, the method making use of this bath and to products produced by means of this method.

Copper layers can be exchanged for thin tin layers, either by means of acid solutions containing thio-urea or derivates, or in solutions containing cyanide. The deposition stops as soon as copper atoms are not visible anymore. Therefore this method is not suitable for an effective protection of copper from atmospheric corrosion. Furthermore, U.S. Pat. No. 3,637,386 discloses electroless tinplating solutions having the $V^{2+}/V^{3+}$ redox system or the $Cr^{2+}/Cr^{3+}$ redox system as the reducing agent. These solutions enable the deposition of thicker tin layers. They are, however, very instable, so that they are not very suitable for practical usage. Swiss Patent No. 284,092 discloses a method of tinplating the bearing surface of bearing brasses and bearing bushes. In accordance with this method the relevant surface is contacted with an aqueous, alkaline stannous salt solution for 30–60 minutes at the boiling point, a thin tin layer being applied onto the copper or copper alloy in this manner. Thicker layers (up to 5 μm) are possible at temperatures over 100° C. and by contacting the surface with Al or Zn. This last-mentioned method is very unpractical. Solutions which require a strong alkaline solution at the boiling point for such a long period of time are not very attractive for large scale practical uses. Furthermore, it is a known fact that tin dissolves in boiling alkali hydroxide without cathodic voltage.

So far it has been also assumed that these solutions work on the principle of exchange. The above-mentioned Swiss Patent Specification therefrom mentions only the metallization of copper or copper alloys.

BRIEF SUMMARY OF THE INVENTION

According to the invention, the bath for the electroless tin deposition on a catalytic surface, consisting of a solution comprising stannous salt in a strong alkaline medium, is characterized in that the solution comprises a quantity of at least 0.20 mole/l of a bivalent stannous salt.

It was found that when a copper surface was plated with tin by means of the bath according to the invention no copper ions are dissolved. Thus the deposition of the metal cannot be based on the principle of exchange. Instead applicants have found that disproportioning takes place in accordance with the equation $$2\ HSnO_2^- \xrightarrow{v_1} SnO_3^{2-} + Sn + H_2O$$

This also explains the surprisingly great influence the concentration of stannous ions appeared to have on the deposition of the tin: $v_1 = k\ [HSnO_2^-]^2$, where $v_1$ is the reaction speed and k a constant.

The process for the electroless deposition of tin is carried out with the bath according to the invention used at a temperature between 60° and 95° C.

When a solution having a stannous salt concentration as mentioned in the above-mentioned Swiss Patent Specification, namely 35 g $SnCl_2.2H_2O$ (=0.155 mole/l) and 55 g NaOH, used at 83° C. instead of 100° C., is compared with an embodiment according to the invention, containing 60 g $SnCl_2.2H_2O$ (0.266 mole/l) and 80 g NaOH at a temperature of 83° C., it appeared that no observable quantity of tin had been deposited with the first-mentioned solution after 2 hours, whereas the solution according to the invention produced an excellent, uniform tin layer within 15 minutes. Of great advantage when making use of the tin plating bath according to the invention is the possibility to selectively deposit a tin pattern without visible fogging outside of the pattern.

In a preferred embodiment of the method for depositing tin with the aid of the electroless tin plating bath according to the invention the temperature of the bath is adjusted between 75° and 90° C.

To increase the solubility of the stannous salt it is advantageous to use sodium or potassium salts of carbonic acids as the complexing agent, such as tin sodium citrate and KNa tartrate.

For the same object the addition of solvents such as ethylene glycol, glycerin or polyethyleneglycols is also very advantageous.

These measures counter the unwanted formation of undissolved SnO and improve in some cases the structure of the formed tin.

The rate of deposition of the tin is increased by adding beforehand a quantity of stannic ions, for example in the form of $SnCl_4.4H_2O$, in a concentration of 0.005–0.03 mole/l.

The reaction proceeds at a surface which is catalytic therefore. This catalytic surface may be a metal layer such as copper, copper alloys and tin itself, which has been deposited as a thin layer by means of another method, as well as a non-conducting substrate, for example glass onto which catalytic nuclei have been applied by means of a known method.

In accordance with a further elaboration of the invention, the tin deposition is accelerated by the addition of a strong reducing agent, for example a hypophosphite or a borazane. To this end at least 0.1 mole/l of such a reducing agent is added to the bath. Thus effect is probably based on depassivation of the surface to be placed owing to the development of hydrogen.

DETAILED DESCRIPTION OF THE INVENTION

Some embodiments will now be described for a better understanding of the invention:

EXAMPLE 1

An aqueous solution (solution A), which is prepared and kept in a nitrogen atmosphere, contains 120 g tertiary sodium citrate
150 ml. oxygen-free deionized water and
40 g stannous chloride.

Copper foil having a surface area of approximately 19 $cm^2$ is immersed for 4 hours at a temperature of 85° C. in a solution (B) consisting of:

65 ml oxygen-free deionized water,
8 g sodium hydroxide and
35 ml of solution A.

A further piece of copper foil, having the same surface area, is immersed at the same temperature in a solution of the same composition B, to which 10 g of sodium hypophosphite has been added (solution C). Although both copper foils are coated with a uniform tin layer within 10 minutes, 7.2 mg of tin had been deposited from solution B onto the copper foil after 4 hours, whereas the foil immersed in solution C had been intensified with 34.3 mg of tin.

Instead of the hypophosphite advantageous use can alternatively be made of a solution of 1% by weight of dimethyl amino borane.

EXAMPLE 2

A piece of copper foil having a surface area of 18 $cm^2$ is treated for 4 hours at a temperature of 85° C. with a solution consisting of:

8 g sodium hydroxide
65 ml. oxygen-free deionized water,
10 g sodium hypophosphite,
500 mg stannic chloride and
35 ml solution A of example 1.

After removal of the loose tin formed at the foil surface it appears that the weight of the tin-plated copper foil had increased by 56.8 mg. If the solution is heated to 75° C. 31.8 mg of tin is deposited on a copper foil having a surface area of 16 $cm^2$ in 4 hours.

EXAMPLE 3

A piece of copper foil having a surface area of 20 $cm^2$ is intensified for 4 hours at a temperature of 85° C. in a solution consisting of:

5 g potassium iodide,
8 g sodium hydroxide,
70 ml oxygen-free deionized water,
10 g sodium hypophosphite,
500 mg stannic chloride and
30 ml solution A of example 1.

The weight of the copper foil has increased by 84.9 mg as a result of the deposition of tin.

EXAMPLE 4

A glass plate having a surface area of 6 $cm^2$ is roughened on one side with carborundum and activated by subjecting it consecutively at room temperature to the following treatments:

1 min. in a solution of 0.1 g stannous chloride and 0.1 ml concentrated hydrochloric acid in 1 l deionized water,
1 min. rinsing in deionized water,
1 min. in a solution of 1 g silver nitrate in 1 l deionized water,
1 min. rinsing in deionized water,
1 min. in a solution of 0.1 mg palladium chloride in 1 l deionized water and 3.5 ml concentrated hydrochloric acid,
1 min. rinsing in deionized water.

The glass surface which was activated by palladium is thereafter intensified at a temperature of 80° C. in a solution consisting of:

65 ml deionized water,
8 g sodium hydroxide,
10 g sodium hypophosphite and
35 ml solution A of Example 1,
52 mg tin is deposited on the catalyzed glass surface.

EXAMPLE 5

An aqueous solution consisting of:

120 g tertiary sodium citrate,
140 ml deionized water,
40 g stannous chloride and
1.6 g sodium hydroxide is prepared and kept in air. 35 ml of this solution is added to a solution containing 5 g potassium fluoride,
65 ml deionized water and
19 g sodium hypophosphite.

Although some precipitate is produced, the solution thus obtained is used, at a temperature of 83° C., for tinplating copper foil and a selectively applied copper pattern which was obtained by electroless copperplating on an epoxy resin substrate having a top layer consisting of titanium dioxide particles, dispersed in an epoxy adhesive. After 5 hours 42.3 mg tin has been deposited on a piece of copper foil having a surface area of 15 $cm^2$, while the selective copper pattern has been provided with a nice tin layer without any trace of fogging.

EXAMPLE 6

A selectively applied copper pattern, which was obtained by means of electroless copperplating on an epoxy resin substrate having a top layer consisting of titanium dioxide particles dispersed in an epoxy adhesive, is treated at 83° C. in a solution consisting of:

50 ml water
50 g ethylene glycol,
15 g stannous chloride,
14 g sodium hydroxide,
10 g sodium hypophosphite and
500 mg stannic chloride, A uniform layer of tin is deposited on the copper pattern within 30 minutes.

Alternatively, it is possible to use glycerin or "Carbowax 300" instead of ethylene glycol. "Carbowax 300" is a polyethelene glycol having a molecular weight of 285 to 315 and is marketed by Union Carbide Chemicals Company.

EXAMPLE 7

A glass sheet, one side of which is roughened with carborundum and has a surface area of 5 $cm^2$ is nucleated in the manner described in Example 4. This activated glass surface is treated, together with a piece of copper foil having a surface area of 9 $cm^2$, at a temperature of 80° C. in a solution consisting of:

8 g sodium hydroxide,
90 ml deionized water,
10 g sodium hypophosphite and
5 g stannous fluoride.

After approximately 2 hours 9.6 mg tin has been deposited on the glass surface and 15 mg on the copper foil. The tinplated copper foil has a shiny appearance and is properly solderable.

What is claimed is:

1. A electroless tinplating bath for the electroless deposition of tin on a catalytic surface, said bath comprising an aqueous alkaline solution of at least 0.20 moles per liter of stannous ions, 0.005 to 0.03 mols per liter of stannic ions and at least 0.1 mols per liter of a reducing agent selected from the group consisting of hypophosphites and borazanes.

2. The electroless tinplating bath of claim 1 further containing a complexing agent selected from the group consisting of trisodium citrate and potassium sodium tartrate.

3. The electroless tinplating bath of claim 1 wherein the reducing agent is sodium hypophosphite.

4. The electroless tinplating bath of claim 1 further containing a polyhydroxy alcohol selected from the group consisting of glycols, glycerin and polyethelene glycols.

5. A process for electroless deposition of tin on a catalytic surface comprising applying to the said surface the electroless tinplating bath of claim 1 at a temperature of between 60° to 95° C.

6. The process of claim 5 wherein the electroless tinplating bath is applied at a temperature of between 75° to 90° C.

* * * * *